United States Patent [19]

Paoluccio

[11] Patent Number: 4,827,719

[45] Date of Patent: May 9, 1989

[54] CLOSED HYDRAULIC SYSTEM WITH DRYING MEANS

[76] Inventor: John A. Paoluccio, 3530 Kiernan St., Modesto, Calif. 95356

[21] Appl. No.: 551,349

[22] Filed: Nov. 14, 1983

[51] Int. Cl.[4] ..... F15B 1/06

[52] U.S. Cl. ..... 60/478; 60/592

[58] Field of Search ..... 60/477, 478, 329, 592; 137/587, 568; 220/85 VR, 85 VS

[56] References Cited

U.S. PATENT DOCUMENTS

| | | | |
|---|---|---|---|
| 2,944,405 | 7/1960 | Basore et al. | 220/85 VS |
| 3,048,958 | 8/1962 | Barnes | 137/587 |
| 3,722,537 | 3/1973 | Gregerson et al. | 137/559 |
| 3,872,886 | 3/1975 | Shotmeyer | 137/558 |

FOREIGN PATENT DOCUMENTS

| | | | |
|---|---|---|---|
| 0640873 | 1/1979 | U.S.S.R. | 60/592 |

*Primary Examiner*—Robert E. Garrett

*Attorney, Agent, or Firm*—Robert S. Smith

[57] ABSTRACT

A hydraulic system which includes an auxiliary reservoir having an elastic fluid impervious chamber and apparatus for sealing the elastic fluid impervious chamber with the interior thereof in fluid communication with the inside of an associated fluid reservoir. Apparatus is provided for preventing excessive positive or negative pressure from building in the reservoir. Some embodiments may include a desiccant to dry the air which is within the reservoir above the liquid hydraulic fluid. A moisture indicator may also be used to visually verify that a tight vapor barrier is maintained. The extended surface area of the auxiliary reservoir also acts as a means of rejecting excess heat generated by the operating hydraulic system.

4 Claims, 6 Drawing Sheets

CLOSED HYDRAULIC SYSTEM WITH DRYING MEANS

RELATED APPLICATION

This application is related to an applicatio of the same inventor for a contamination control device, filed concurrently with this application.

BACKGROUND OF THE INVENTION

The invention relates to fluid systems including hydraulic systems of the type wherein a reservoir supplies fluid to a hydraulic pump which supplies high pressure fluid to one or more hydraulic fluid operated devices. Such fluid operated devices include piston-cylinder assemblies and hydraulic motors or the like, as well as lubrication systems wherein a reservoir supplies a fluid to a pump which, in turn, supplies a lubricant to one or more bearings. Various other applications such as commercial processes utilizing various fluids will be apparent to those skilled in the art. The invention has application to systems utilizing (1) petroleum based lubricants and hydraulic fluids and (2) synthetic fluids including synthetic hydraulic fluids as well as to other fluids.

Many hydraulic systems in both industrial and commercial applications are exposed to substantial contamination and, thus, are highly vulnerable. For example, garbage trucks commonly have hydraulic system utilizing thirty gallon reservoirs and suffer repetitive failures of expensive hydraulic equipment. Similar problems occur in numerous other industrial hydraulic systems. Frequently the expense of the individual hydraulic system components is very great. In addition, the down time of the equipment involved is also very significant.

The reservoirs for typical fluid systems are typically open to the atmosphere. The exposure of the hydraulic fluid or the lubricant in the reservoir to the atmosphere is undesirable because it results in contamination of the lubricant or other hydraulic fluid as well as contamination of the atmosphere. The contamination of the hydraulic or other fluid is typically caused by the ambient air entering and leaving the reservoir during operation of the system. The interior metal surfaces of the reservoir are typically coated with a sticky oil to which dirt particles in the dirty ambient air attach themselves. This process of "air breathing", as it is called in industry, is a major source of hydraulic or other fluid contamination.

In addition there is another detrimental effect to the lubricant or hydraulic fluid. Moisture contamination may be even more damaging. The water vapor pressure of the ambient air varies with many environmental factors. Whenever the temperature of the reservoir is less than the dew point of the ambient air, condensation occurs. The condensed water then enters the hydraulic fluid system. Numerous problems can and do result from this effect. Adsorption of gases into the hydraulic fluid may also occur.

As a result of the dirt and moisture contamination of the hydraulic fluid, the lives of all moving parts in the hydraulic system including pumps and various moving apparatus are greatly reduced. In addition, hydraulic fluid and filter must be changed more frequently.

More specifically, in the conventional hydraulic system the quantity of fluid in the hydraulic system reservoir can vary substantially during the operating cycle. Various valves may be opened or closed, a cylinder may be full or empty, etc., and, thus the quantity of hydraulic fluid in the reservoir varies substantially during normal operation. In addition, the volumetric expansion rate for the hydraulic fluid and air in the reservoir differs substantially. In the conventional system the air breather cap, which may also be a fill cap, allows air to enter and leave as the volume of hydraulic fluid and air in the reservoir varies. For example, the oil level in the reservoir may change only 10 percent due to temperature changes and system operation. However, the air volume above the reservoir may vary 30 percent from temperature changes. This results in a 40 percent total volume change. Since the oil remains in the system, the entire 40 percent volume change is created by the air.

The prior art includes the apparatus described in U.S. Pat. Nos. 4,135,635; 3,330,902; 2,095,752; 1,652,793; and 4,161,964. These devices have not been wholly satisfactory because, in part, they expose a reservoir to high pressure or to a negative pressure, at least in come cases. Thus, if such prior art were retrofitted in some existing hydraulic systems, it is probable that damage to the reservoir might result. In addition, the prior art apparatus did not adequately provide for removal of moisture from the air within a closed hydraulic system.

It is an object of the invention to provide apparatus which eliminates contamination of the lubricant or other hydraulic fluid.

It is another object of the invention to provide apparatus which visually shows if the air within the system is dry or if it is wet, also helping to determine if the system has an air leak.

It is another object of the invention to provide apparatus which eliminates atmospheric contamination.

It is another object of this invention to provide apparatus which visually shows if the air within the system is at a slight positive or negative pressure.

It is another object of the invention to provide apparatus which will not require periodic maintenance.

It is another object of this invention to provide apparatus which increases surface area for the rejection of excess heat.

Yet another object of the invention is to provide apparatus which attains the various objects of the invention while being very inexpensive to manufacture and install even on existing hydraulic systems.

Still another ojbect of the invention is to provide apparatus which is simple to manufacture.

SUMMARY OF THE INVENTION

The foregoing objects and other objects and advantages which shall become apparent from the detailed description of the preferred embodiment are attained in an auxiliary reservoir for use either as part of or with an associated fluid system, which comprises an elastic fluid impervious chamber and means for sealing the elastic fluid impervious chamber with the interior thereof in fluid communication with the inside of a fluid reservoir. The auxiliary reservoir may further include a housing disposed in spaced relationship around the elastic fluid impervious chamber with at least portions of the space intermediate the housing and the elastic fluid impervious chamber vented to atmosphere, or substantially all the space intermediate the housing and the elastic fluid impervious chamber may be vented to the atmosphere. The auxiliary reservoir may include a vacuum release means either alone or in combination with a pressure release means. A compound pressure gauge may also be used.

In some forms a desiccant may be provided in fluid communication with the interior of the reservoir.

BRIEF DESCRIPTION OF THE ACCOMPANYING DRAWING

The invention will be better understood by reference to the accompanying drawing in which.

DESCRIPTION OF THE PREFERRED EMBODIMENT

Figure 2:
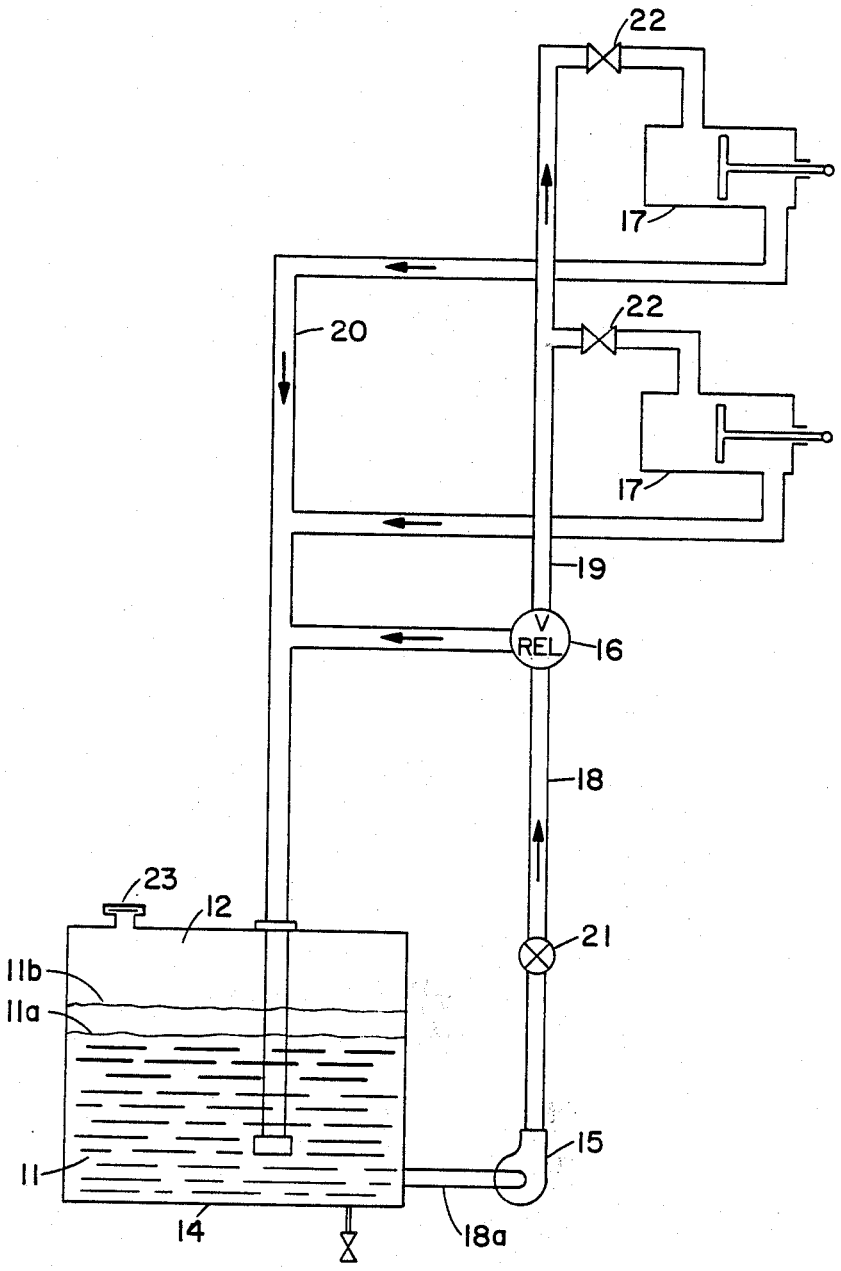
FIG. 2 is a schematic view of a prior art hydraulic system.
Figure 3:
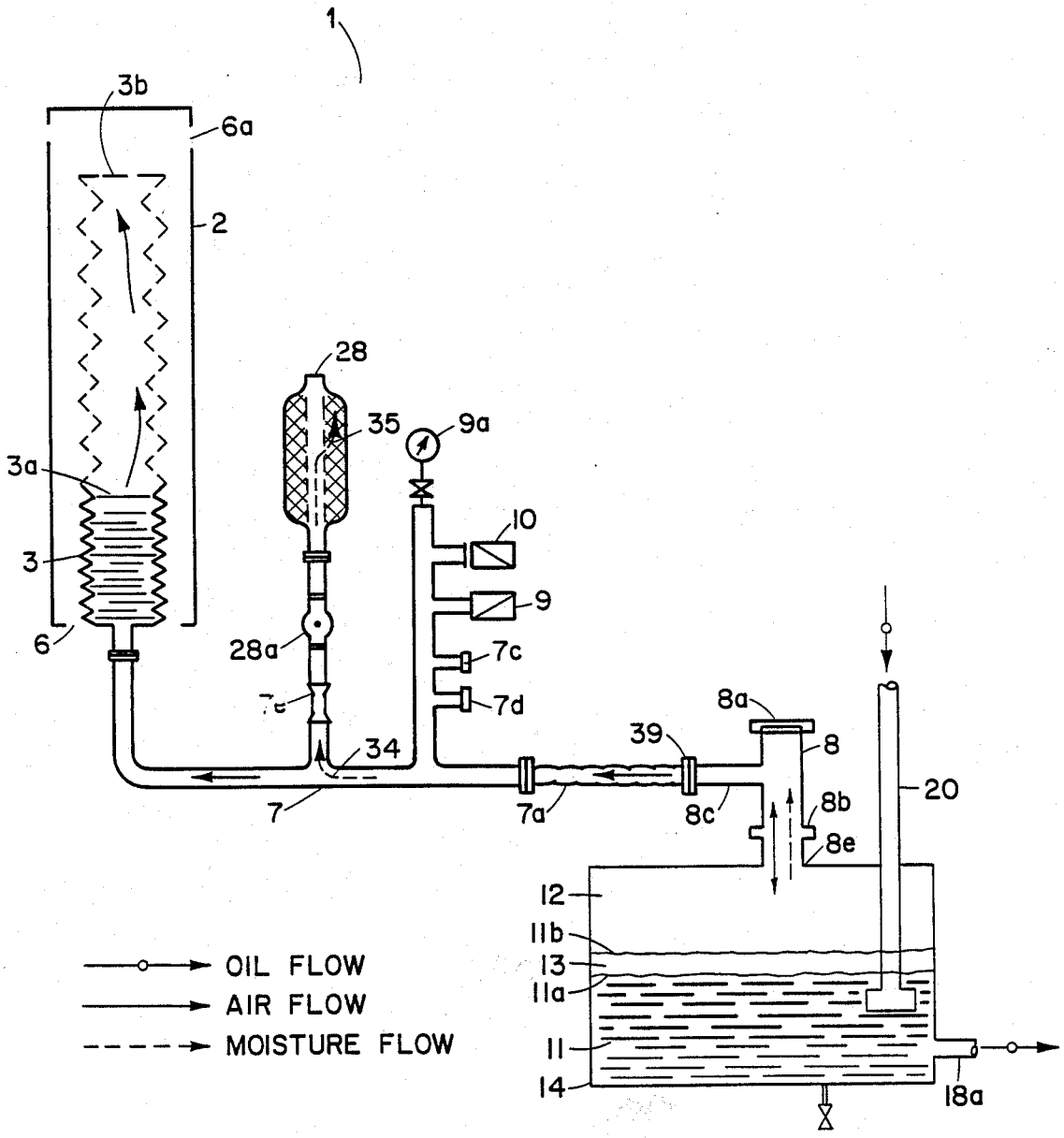
FIG. 3 is an enlarged view of the invention which shows the main features.

Referring now to FIG. 2, there is shown a prior art system having a reservoir 14 in which is disposed a hydraulic fluid 11. The fluid 11 is supplied to a pump 15. The outlet of the pump 15 feeds an outlet pipe 18 via a control valve 21. A relief valve 16 allows passage of the hydraulic fluid 11 back to the reservoir 14 when a predetermined pressure is exceeded. The hydraulic fluid 11 under pressure, as determined by the relief valve 16, passes each piston and cylinder assembly 17, 17. In at least one case, the high pressure hydraulic fluid 11 in the outlet pipe 18 passes through a modulating valve 22 before reaching the piston and cylinder assembly 17. The hydraulic fluid 11 passing out of the piston and cylinder assemblies 17, 17 is directed to the reservoir 14. As the system operates, the oil temperature increases, thus, warming the air above the reservoir 14. This aids in heat dissipation. As the volume of the hydraulic fluid 11 in the reservoir 14 varies, the volume of the hydraulic fluid 11 within the reservoir 14 causes air to pass either in or out of an air breather and fill cap 23.

Figure 1:
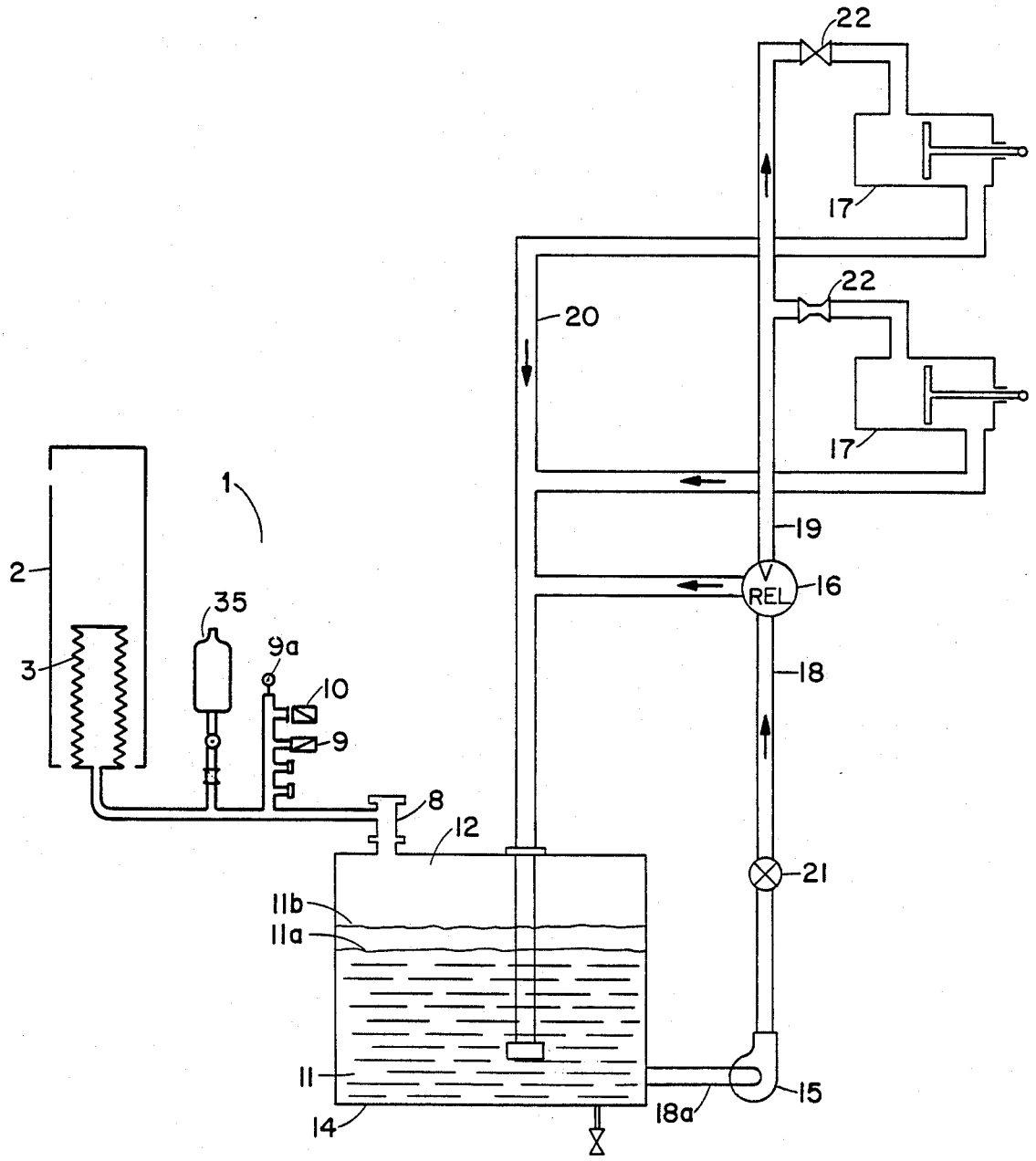
FIG. 1 is a schematic view of a hydraulic system having the features of the invention incorporated therein.

Referring now to FIG. 1, thee is shown apparatus in accordance with the invention which utilizes a generally similar reservoir 14 containing the hydraulic fluid 11, which is supplied to a hydraulic pump 15 and hence, as in the apparatus illustrated in FIG. 2, to the outlet pipe 18 via the control valve 21 and then to the relief valve 16 and the piston and cylinder assemblies 17, 17 via the modulating valve 22. Return flow to the reservoir 14 is via a return line 20, as in the apparatus in FIG. 2.

Unlike the apparatus in FIG. 2, the air breather and fill cap 23 is replaced by an auxiliary reservoir system with a sealed cap and a variable volume device 1. The variable volume device 1 includes a housing or shell 2 in which is disposed a bellows or an elastic chamber 3. The bellows or elastic chamber 3 is sealed in fluid tight communication with the interior of the reservoir 14. Open vents 6 are provided in the housing or shell 2 so that the air pressure on the outside of the bellows or elastic chamber 3 permit passage of ambient air with its contamination, including moisture, on the outside of the bellows or elastic chamber 3. Disposed in fluid communication with the interior of the bellows or elastic chamber 3 are respectively a vacuum relief valve 9 and a pressure relief valve 10, both of which might typically be set at four inches of water. Also in fluid communication with the interior of the bellows or elastic chamber 3 as well as in communication with the interior of the reservoir 14 is a desiccant 28, which insures that the air trapped within the bellows or elastic chamber 3 and above the surface of the hydraulic fluid 11 in the reservoir 14 stays dry. The pressure gauge **9*a* visually shows the internal air pressure. The moisture indicator 28*a*** visually shows the degree of air dryness.

The vacuum relief valve 9 and the pressure relief valve 10 are provided in part to accommodate changes in oil volume that occur due to variation in temperature. In many systems it may never be necessary for such valves 9, 10 to actuate. For unusual conditions the inclusion of these valves 9, 10 cause the system to operate temporarily as an open system, as in the prior art, such as in the event of some malfunction.

Contrary to the prior art systems which allow dirty ambient air 5 to enter and leave the reservoir 14, the present system allows such dirty air 5 only to enter the space between the housing or shell 2 and the bellows or elastic chamber 3. The fluid system including the reservoir 14 is thereby kept clean and free from dirt and moisture. Thus, the system will work in various weather conditions including hot and dry conditions, cold and wet conditions, and even rainy and foggy conditions. In addition, even when the hydraulic system is turned off such as during the night, the effects of moisture and vapor pressure are completely eliminated. Vapor migration can occur even without extensive air movement. With the present invention, the bellows or elastic chamber 3 acts as a vapor barrier. If the system is initially dry and moisture free, then there will be no moisture problem.

The advantages of the variable volume device 1 in accordance with the invention include virtual elimination of contamination from dust and moisture via the air breather and fill cap 23 along with the problems that result from such dust and moisture. Equipment life is greatly extended, and the frequency of filter and oil or other fluid changes will be dramatically reduced.

When the variable volume device 1 is provided with the apparatus in accordance with the invention, the system changes from an open system to a closed system. Initially, only a small amount of contamination enters the reservoir 14 through the original air. Since no more air is allowed to enter the closed system, the air within the reservoir 14 stays clean.

Figure 6:
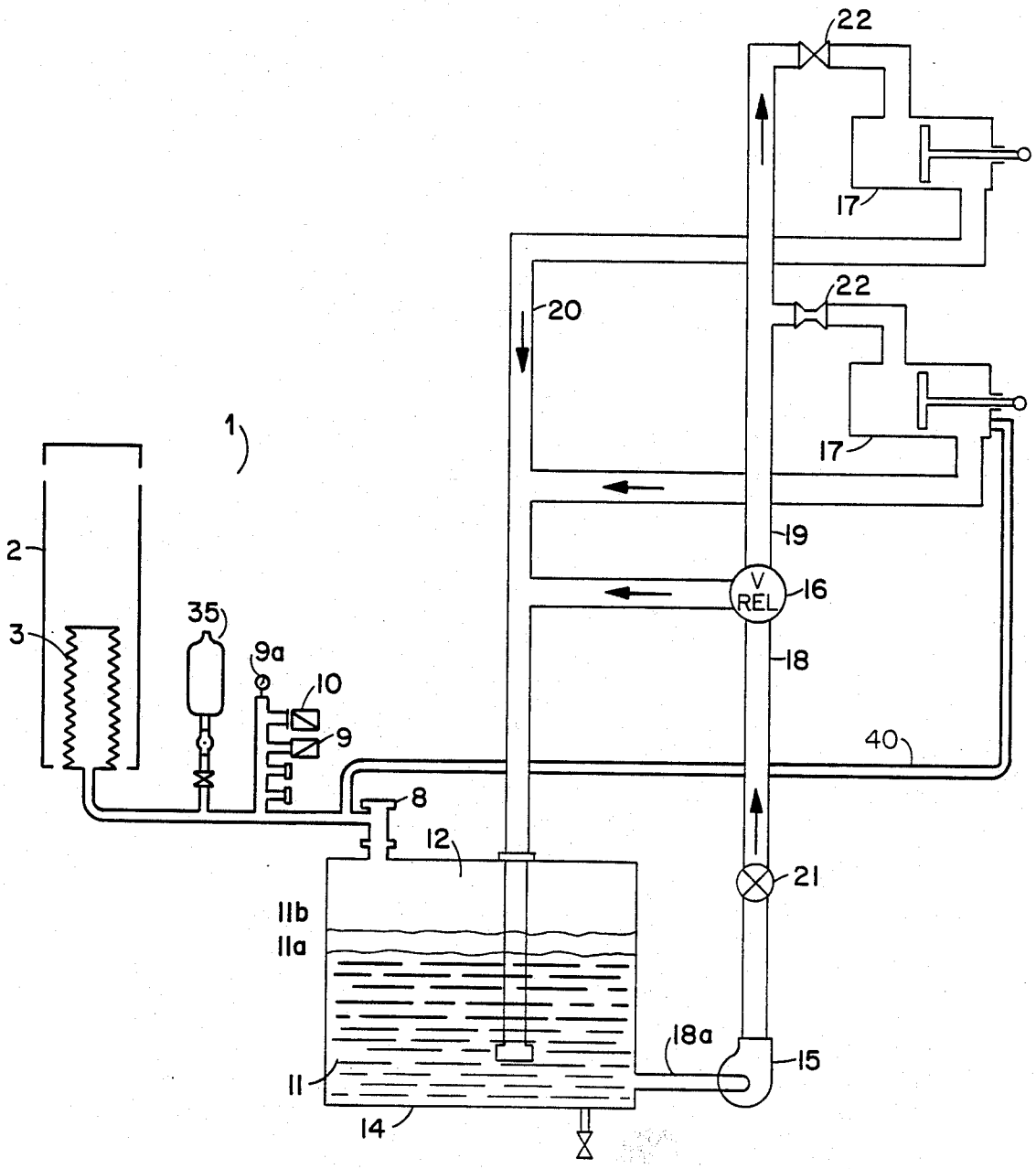
FIG. 6 is a schematic view of the invention which shows the extension of the closed system air line routed to a cylinder, thereby making it a closed system.

It will be understood than when the hydraulic fluid 11 level in the reservoir 14 varies, the flexible portion of the bellows or elastic chamber 3 moves to maintain the initial combined volume of both oil and air in the reservoir 14; FIG. 6 shows an air line 40 which extends from the air vent of a hydraulic cylinder 17. Applications for the apparatus in accordance with the invention are not limited to conventional fluid power systems. More specifically, the invention may be used in lubrication systems in an automobile as well as in various other engines including diesel engines, lawnmower engines, and other internal combustion engines as well as in industrial processes where a closed system is desirable and a variable volume is necessary.

It will be seen that the apaaratus in accordance with the invention, by utilizing both vacuum and pressure relief valves 9, 10 together with the elastic chamber 3, isolates the hydraulic fluid 11 from outside contamination and maintains that hydraulic fluid 11 at substantially ambient pressure. Only during unusual conditions will either of the valves 9, 10 open and, thus, briefly expose the hydraulic fluids 11 and air in the reservoir 14 to atmospheric contaminants. Advantageously, the embodiments of the invention utilizing the desiccant 28 in combination with the closing of the system, i.e. isolated from ambient contamination, will have even cleaner hydraulic fluid 11.

Referring to FIG. 6, there is shown a system which includes hydraulic cylinders 17 having an air return line 40 extending from the back side of a piston thereof. The air return line 40 is in fluid communication with the reservoir 14 and the elastic chamber 3.

Figure 5:
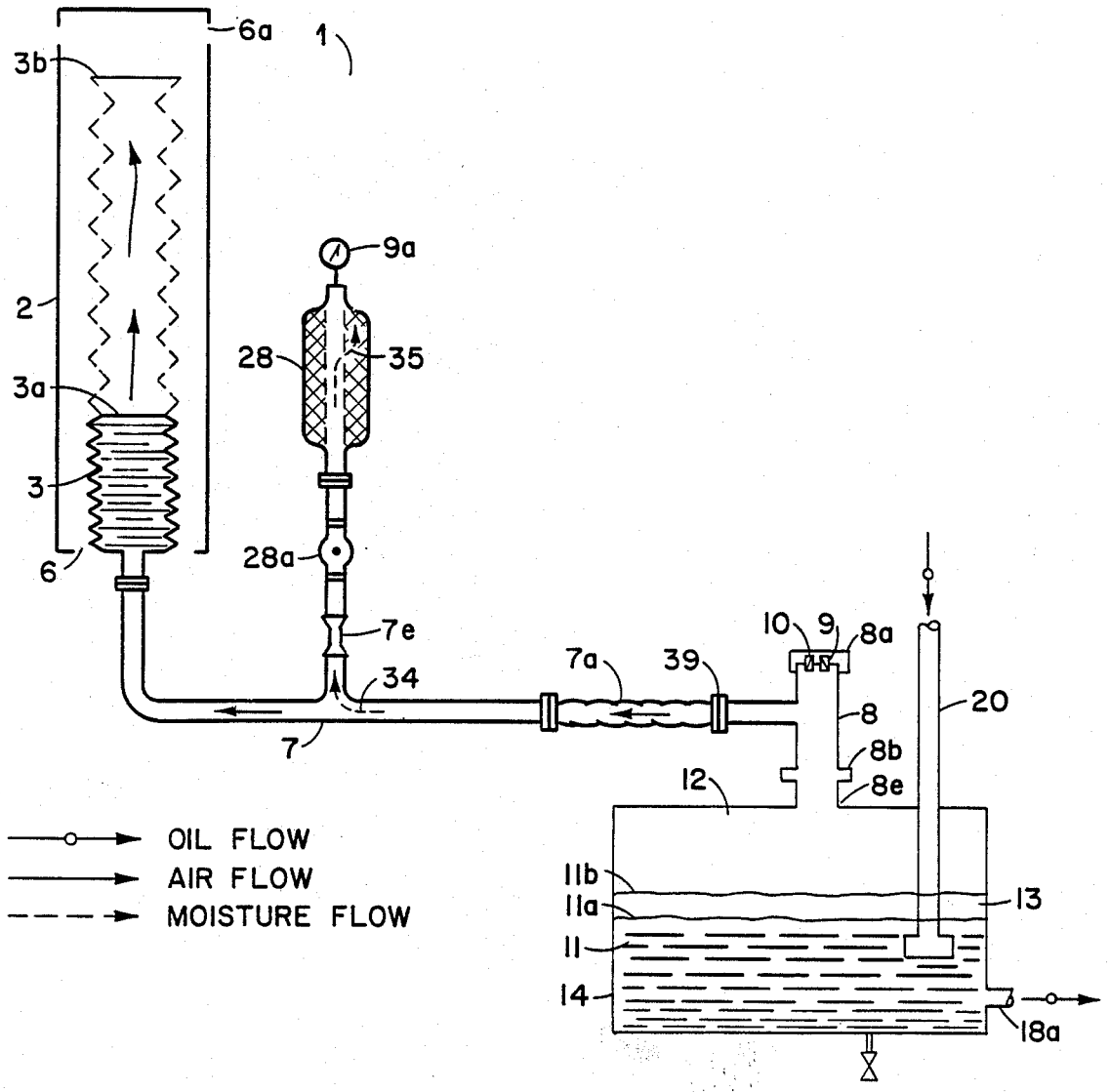
FIG. 5 is an enlarged view of the invention which shows an alternate method with a combination seal cap containing pressure and vacuum relief features.

FIG. 5 illustrates an embodiment of the invention in which a cap 8*a* for the reservoir 14 includes integral vacuum and pressure relief valves 9, 10.

Figure 4:
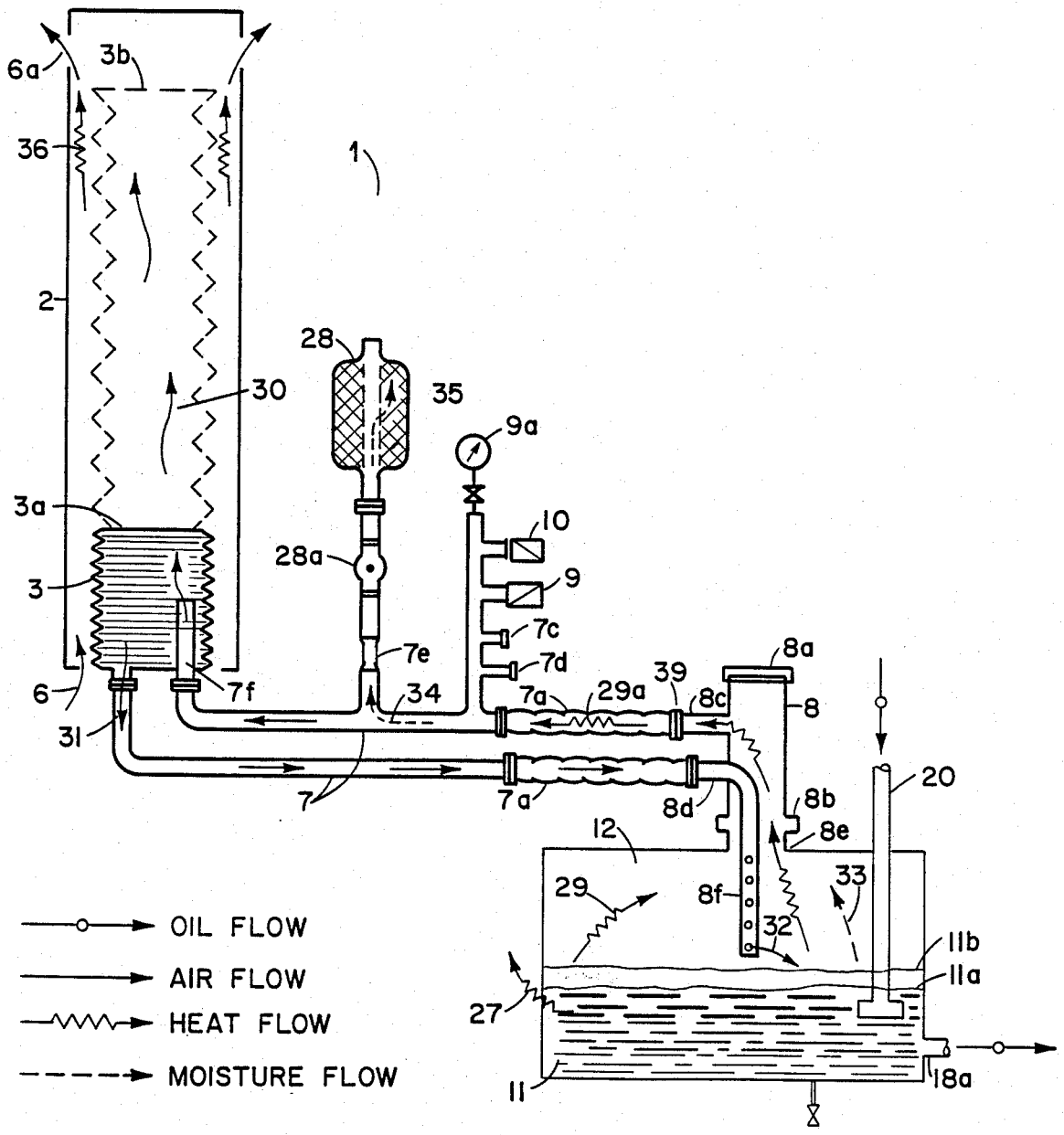
FIG. 4 is an enlarged view of the invention which shows the addition of a return line for use with high temperature hydraulic systems.

FIG. 4 illustrates another embodiment in which an air return line 7 from the elastic chamber 3 terminates in a perforated conduit 8*f* disposed proximate to the top of the oil level in the reservoir. A plurality of openings are positioned at a plurality of axial locations. This location helps to maintain an air thermal siphon circulation loop for cooling relatively hot hydraulic fluids.

The invention has been described with reference to its illustrated preferred embodiment. Persons skilled in the art of constructing fluid systems may, upon exposure to the teachings herein, conceive variations in the mechanical development of the components therein as well as the applications for he apparatus. For example, the apparatus may be used for systems other than hydraulic systems. Such variations are deemed to be encompassed by the disclosure, the invention being delimited only by the appended claims.

Having thus described my invention, I claim:

1. A hydraulic system, which includes:

means for utilizing pressurized fluid;

pump means for placing an associated fluid under pressure;

a primary reservoir for supplying a fluid to said pump;

an auxiliary reservoir for said primary reservoir, said auxiliary reservoir comprising an elastic fluid imperious chamber disposed in fluid tight connection with said primary reservoir, said auxiliary reservoir further including a housing disposed in spaced relationship around said elastic fluid impervious chamber with at least portions of the space intermediate said housing and said elastic fluid impervious chamber being vented to atmosphere, said auxiliary reservoir includes a vacuum release means;

substantially all the space intermediate said housing and said elastic fluid impervious chamber being vented to atmosphere;

a desiccant disposed in continuous fluid communication with the interior of said elastic fluid impervious chamber; and a visual sight glass that indicates the degree of moisture in the air within said system.

2. The apparatus as described in claim 1, further including:

an air return line from said auxiliary reservoir to said primary reservoir, terminating in a perforated conduit in the primary reservoir to effectively maintain an air thermal siphon circulation loop to increase the effectiveness of heat rejection from the air within the hydraulic system.

3. The apparatus as described in claim 2, further including: fluid communication means joining an air return line from an air vent of an associated hydraulic cyclinder and said elastic fluid impervious chamber.

4. The apparatus as described in claim 3, further including: a cap with a built-in pressure relief valve and vacuum relief valve.

* * * * *